US009115854B2

(12) United States Patent
Chiu et al.

(10) Patent No.: US 9,115,854 B2
(45) Date of Patent: Aug. 25, 2015

(54) LIGHT EMITTING DIODE BULB

(71) Applicant: Beautiful Light Technology Corp., Chiayi (TW)

(72) Inventors: Shih-Ting Chiu, Chiayi (TW); Chien-Wen Chiu, Chiayi (TW)

(73) Assignee: BEAUTIFUL LIGHT TECHNOLOGY CORP., Chiayi (TW)

( * ) Notice: Subject to any disclaimer, the term of this patent is extended or adjusted under 35 U.S.C. 154(b) by 23 days.

(21) Appl. No.: 14/252,759

(22) Filed: Apr. 14, 2014

(65) Prior Publication Data

US 2015/0137678 A1 May 21, 2015

(30) Foreign Application Priority Data

Nov. 15, 2013 (TW) ..... 102141702 A

(51) Int. Cl.

| | |
|---|---|
| ***H01J 5/48*** | (2006.01) |
| ***H01J 5/50*** | (2006.01) |
| ***F21K 99/00*** | (2010.01) |
| ***F21V 29/70*** | (2015.01) |
| *F21V 3/00* | (2015.01) |
| *F21V 17/02* | (2006.01) |

(Continued)

(52) U.S. Cl.

CPC ..... *F21K 9/1355* (2013.01); *F21K 9/135* (2013.01); *F21K 9/137* (2013.01); *F21K 9/58* (2013.01); *F21V 29/70* (2015.01); *F21V 3/00* (2013.01); *F21V 17/02* (2013.01); *F21V 17/14* (2013.01); *F21Y 2101/02* (2013.01)

(58) Field of Classification Search

CPC ..... F12K 9/135; F12K 9/1355; F12K 9/137; F12K 9/58; F21V 17/02; F21V 17/14; F21V 29/70; F21V 3/00

USPC ..... 313/318.01, 498, 512, 318.03, 318.1; 362/382, 294, 249.02, 363, 310, 427, 362/282, 362, 253

See application file for complete search history.

(56) References Cited

U.S. PATENT DOCUMENTS

2006/0227558 A1 10/2006 Osawa et al.
2008/0310158 A1 12/2008 Harbers et al.

(Continued)

FOREIGN PATENT DOCUMENTS

JP 2010-287523 A 12/2010
JP 2011-090828 A 5/2011

(Continued)

*Primary Examiner* — Thomas A Hollweg
*Assistant Examiner* — Kevin Quarterman
(74) *Attorney, Agent, or Firm* — CKC & Partners Co., Ltd.

(57) ABSTRACT

A light emitting diode bulb is described, which includes a lamp housing, a light source module, a lampshade and a lamp cap. The lamp housing includes a first adjusting member and a second adjusting member. The first adjusting member includes a first engaging structure, a first acting surface and a second acting surface. The first acting surface and the second acting surface are located on the first engaging structure. The second adjusting member can be moved in relation to the first adjusting member. The second adjusting member includes a second engaging structure corresponding to the first engaging structure, and the second engaging structure has an upper opposing surface and a lower opposing surface. The light source module is disposed on the second adjusting member and can be moved as the second adjusting member is moved. The lampshade and the lamp cap are disposed on the lamp housing respectively.

10 Claims, 6 Drawing Sheets

(51) Int. Cl.
*F21V 17/14* (2006.01)
*F21Y 101/02* (2006.01)

(56) References Cited

U.S. PATENT DOCUMENTS

| | | | | |
|---|---|---|---|---|
| 2010/0097806 | A1* | 4/2010 | Kao | 362/253 |
| 2010/0264821 | A1* | 10/2010 | Lutz et al. | 315/32 |
| 2012/0048511 | A1* | 3/2012 | Moshtagh | 165/80.2 |
| 2012/0080994 | A1* | 4/2012 | Chin et al. | 313/46 |
| 2012/0187836 | A1* | 7/2012 | Hashimoto et al. | 315/51 |
| 2012/0212969 | A1 | 8/2012 | Jen et al. | |
| 2012/0236580 | A1 | 9/2012 | Cheng et al. | |
| 2012/0293961 | A1* | 11/2012 | Yamamoto et al. | 361/714 |
| 2013/0051035 | A1* | 2/2013 | Cho et al. | 362/373 |
| 2013/0058083 | A1* | 3/2013 | Cho et al. | 362/235 |
| 2013/0229103 | A1 | 9/2013 | Lutz et al. | |
| 2013/0242580 | A1* | 9/2013 | Stephany et al. | 362/427 |
| 2014/0036497 | A1* | 2/2014 | Hussell et al. | 362/235 |
| 2014/0084787 | A1* | 3/2014 | Tsai | 315/50 |
| 2014/0085899 | A1* | 3/2014 | Hisayasu et al. | 362/260 |
| 2014/0268826 | A1* | 9/2014 | Pickard et al. | 362/373 |

FOREIGN PATENT DOCUMENTS

| | | | |
|---|---|---|---|
| JP | 2012-014986 | A | 1/2012 |
| JP | 2012-252992 | A | 12/2012 |
| WO | 2012168860 | A2 | 12/2012 |

* cited by examiner

LIGHT EMITTING DIODE BULB

RELATED APPLICATIONS

This application claims priority to Taiwan Application Serial Number 102141702, filed Nov. 15, 2013, which is herein incorporated by reference.

BACKGROUND

1. Field of Invention

The present invention relates to a bulb, and more particularly to a light emitting diode bulb.

2. Description of Related Art

Light emitting diodes (LEDs) have advantages of small size, low driving voltage, long service life and environmental protection. Therefore, light emitting diode bulbs (LED bulbs) have gradually replaced conventional tungsten bulbs and have been used widely. The LED bulbs are typically divided into two types, which are semi-directional LED bulbs and omni-directional LED bulbs. The difference between the semi-directional LED bulbs and the omni-directional LED bulbs are light-emitting angles. The light-emitting angles of the semi-directional LED bulbs are about 100 degrees, and the light-emitting angles of the omni-directional LED bulbs are about 200 degrees. Therefore, the LED bulbs with different light-emitting angles can be applied on various occasions according to requirements.

However, some LED bulbs only have one single light-emitting angle, for example, omni-directional or semi-directional light-emitting angle. For users, if different light-emitting angles are required in one occasion, the users have to pay doubled price to buy the two types of the LED bulbs with different functions for replacement. For manufacturers, methods for manufacturing LED bulbs having two different functions are different, and the manufacturers have to separately manufacture the LED bulbs having the different functions, thus increasing the production cost. For sellers, the sellers have to sell the two types of the LED bulbs having the different functions to meet market requirements, which is disadvantageous to controlling selling cost.

SUMMARY

One aspect of the present invention is to provide a light emitting diode bulb, in which the position of a light source module in a lampshade can be changed by changing the relative location of a first adjusting member and a second adjusting member. Therefore, the light emitting diode bulb can be switched into an omni-directional lighting mode or a semi-directional lighting mode.

Another aspect of the present invention is to provide a light emitting diode bulb, in which heat generated by light emitting diode modules can be conducted from a base to a second adjusting member and further dissipated to the external atmosphere, so as to achieve a superior heat dissipation efficacy. Moreover, it can prevent users from getting an electric shock or being scalded by using heat conducting plastics.

According to the aforementioned aspects, the present invention provides a light emitting diode bulb. The light emitting diode bulb includes a lamp housing, a light source module, a lampshade and a lamp cap. The lamp housing includes a first adjusting member and a second adjusting member. The first adjusting member includes at least one first engaging structure, a first acting surface and a second acting surface. The first acting surface and second acting surface are respectively located on an upside and an underside of the first engaging structure. The second adjusting member can be moved along the axis in relation to the first adjusting member and be fixed at a first position or a second position, in which the second adjusting member includes at least one second engaging structure corresponding to the at least one first engaging structure. The second adjusting member includes an upper opposing surface and a lower opposing surface. When the second adjusting member is fixed at the first position, the upper opposing surface is against the second acting surface. When the second adjusting member is fixed at the second position, the lower opposing surface is against the first acting surface. The light source module is disposed on the second adjusting member and is moved along the axis with the second adjusting member. The lampshade is disposed on a top end of the lamp housing and covers the light source module. The lamp cap is disposed on a bottom end of the lamp housing.

According to an embodiment of the present invention, each of the first acting surface and the second acting surface is an inclined plane, and the inclined plane is inclined downward from a portion of the inclined plane away from the first engaging structure to a portion of the inclined plane near the first engaging structure.

According to another embodiment of the present invention, each of the first acting surface and the second acting surface is a curved surface, and the curved surface is inclined downward from a portion of the inclined plane away from the first engaging structure to a portion of the inclined plane near the first engaging structure.

According to still another embodiment of the present invention, the first engaging structure is a recess, and the second engaging structure is a protruding block.

According to further another embodiment of the present invention, the light source module includes a base and at least one light emitting diode module. The base is fixed on the second adjusting member, in which the base has a flange. When the second adjusting member is fixed at the first position, the flange is against the first acting surface. The light emitting diode module is disposed on the base.

According to yet another embodiment of the present invention, the second adjusting member includes an extending portion, the first adjusting member is an annular structure, and the first adjusting member is put around the extending portion.

According to still further another embodiment of the present invention, the first adjusting member includes a retaining wall. An accommodating space is formed between the retaining wall and an outer wall of the first adjusting member, and a bottom of the lamp shade is disposed within the accommodating space.

According to yet further another embodiment of the present invention, the first engaging structure is disposed on the retaining wall.

According to yet further another embodiment of the present invention, the base and the lamp cap are made of metal.

According to yet further another embodiment of the present invention, the first adjusting member and the second adjusting member are made of heat conducting plastics.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
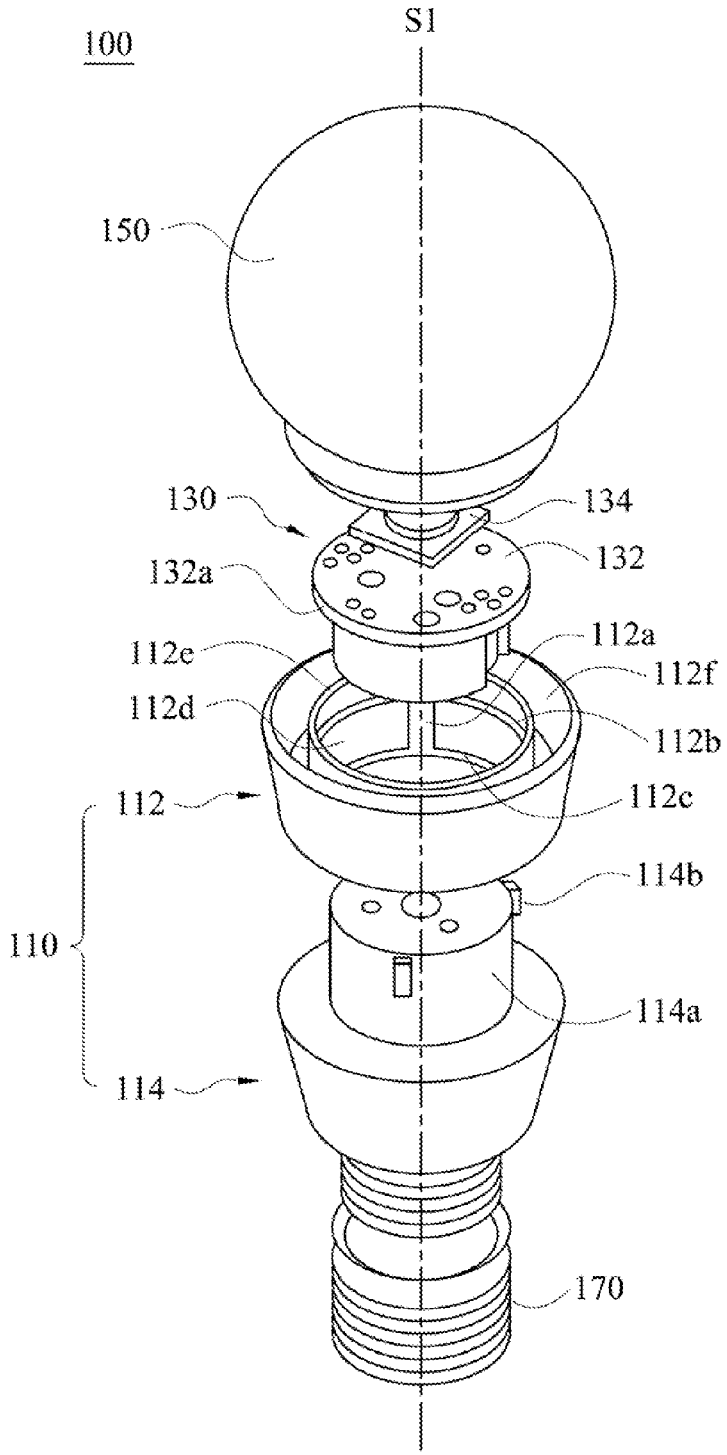
FIG. 1 is a three-dimensional diagram showing a light emitting diode bulb in accordance with an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
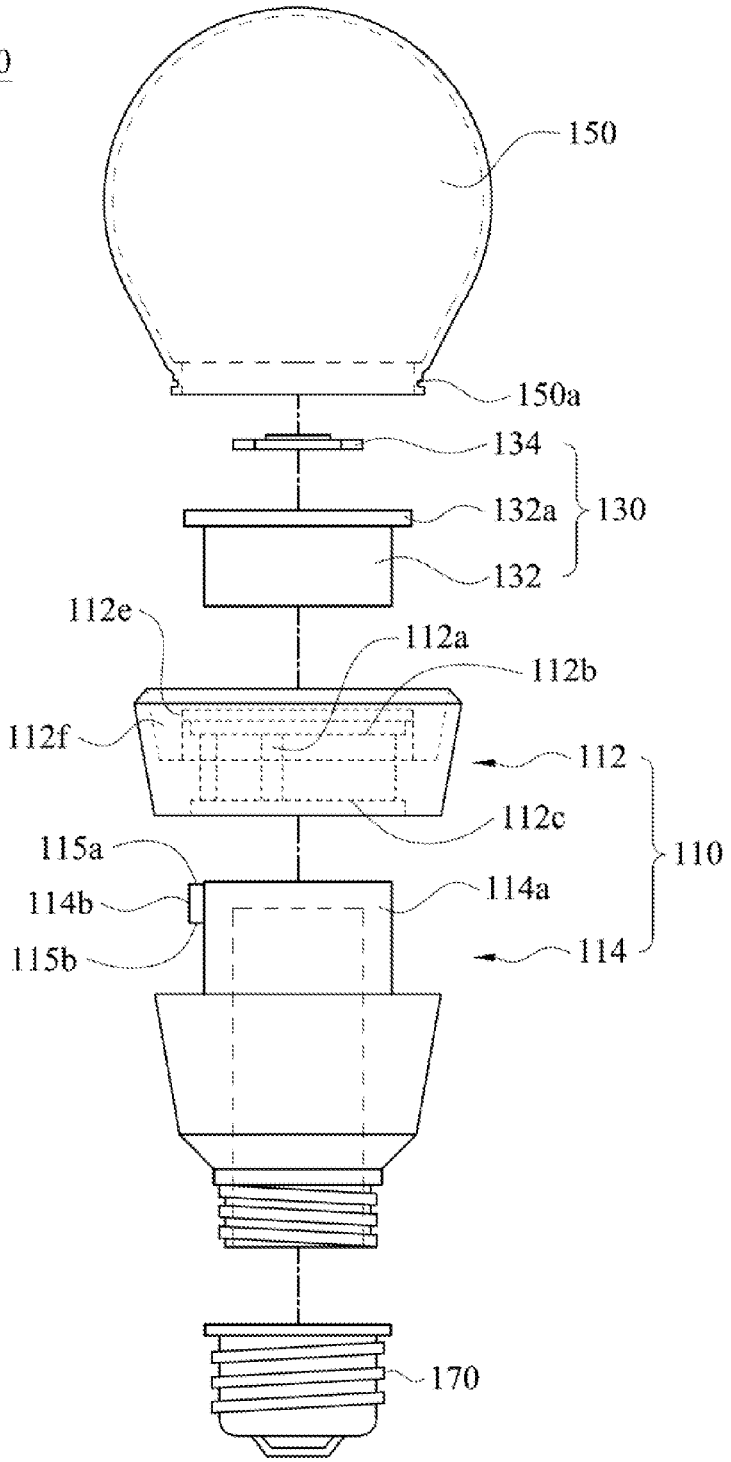
FIG. 2 is a structure-exploded diagram showing a light emitting diode bulb in accordance with an embodiment of the present invention.

Simultaneously refer to FIG. 1 and FIG. 2. FIG. 1 is a three-dimensional diagram showing a light emitting diode bulb in accordance with an embodiment of the present invention, and FIG. 2 is a structure-exploded diagram showing a light emitting diode bulb in accordance with an embodiment of the present invention. In the present embodiment, a light emitting diode bulb 100 includes a lamp housing 110, a light source module 130, a lampshade 150, a lamp cap 170 and a driving circuit (not shown). The lampshade 150 is disposed on a top end of the lamp housing 110, and the lamp cap 170 is disposed on a bottom end of the lamp housing 110. Therefore, the lampshade 150, the lamp housing 110 and the lamp cap 170 are combined to form a shape of a typical bulb. The driving circuit is disposed in the lamp housing 110 and electrically connected to the light source module 130 and the lamp cap 170. Moreover, the lamp cap 170 is screwed into a light bulb socket to conduct electric power to the driving circuit to light the light source module 130.

Referring to FIG. 1 and FIG. 2 again, the light emitting diode bulb 100 has an axis S1. The lamp housing 110 includes a first adjusting member 112 and a second adjusting member 114. The second adjusting member 114 can be moved along the axis S1 in relation to the first adjusting member 112 and can be fixed at a first position or a second position. Moreover, the light source module 130 is disposed on the second adjusting member 114. Therefore, the position of the light source module 130 can be changed by fixing the second adjusting member 114 at the first position or the second position, so as to switch the light emitting diode bulb 100 into an omni-directional lighting mode or a semi-directional lighting mode.

In one embodiment, the first adjusting member 112 is an annular structure, and the second adjusting member 114 includes an extending portion 114*a*. Therefore, the first adjusting member 112 can be put around the extending portion 114*a*. Moreover, the first adjusting member 112 includes at least one engaging structure 112*a* disposed on an inner wall of the annular structure, and the second adjusting member 114 includes at least one engaging structure 114*b* disposed on the extending portion 114*a*. When the first adjusting member 112 is put around the extending portion 114*a*, the engaging structure 112*a* and the engaging structure 114*b* can be aligned and wedged with each other.

As shown in FIG. 1 and FIG. 2, the first adjusting member 112 includes a first acting surface 112*b* and a second acting surface 112*c*. The first acting surface 112*b* and the second acting surface 112*c* are respectively located on an upside and an underside of the engaging structure 112*a*. In one example, the inner wall of the first adjusting member 112 has a convex wall 112*d*, and the engaging structure 112*a* is a recess recessed into the convex wall 112*d*, in which a top surface and a bottom surface of the convex wall 112*d* can be respectively defined as the first acting surface 112*b* and the second acting surface 112*c*. Correspondingly, the engaging structure 114*b* may be a protruding block protruding from the extending portion 114*a*, and the engaging structure 114*b* includes an upper opposing surface 115*a* and a lower opposing surface 115*b*. Therefore, when the second adjusting member 114 is moved in relation to the first adjusting member 112, the engaging structure 114*b* is moved within the engaging structure 112*a* along the recessed engaging structure 112*a*. In addition, the light source module 130 is disposed on the second adjusting member 114, so that the light source module 130 can be moved along the axis S1 with the second adjusting member 114.

In one embodiment, the light source module 130 includes a base 132 and at least one light emitting diode module 134. The base 132 is fixed on the second adjusting member 114, and the light emitting diode module 134 is disposed on the base 132. Moreover, the base 132 has a flange 132*a*.

Figure 3A:
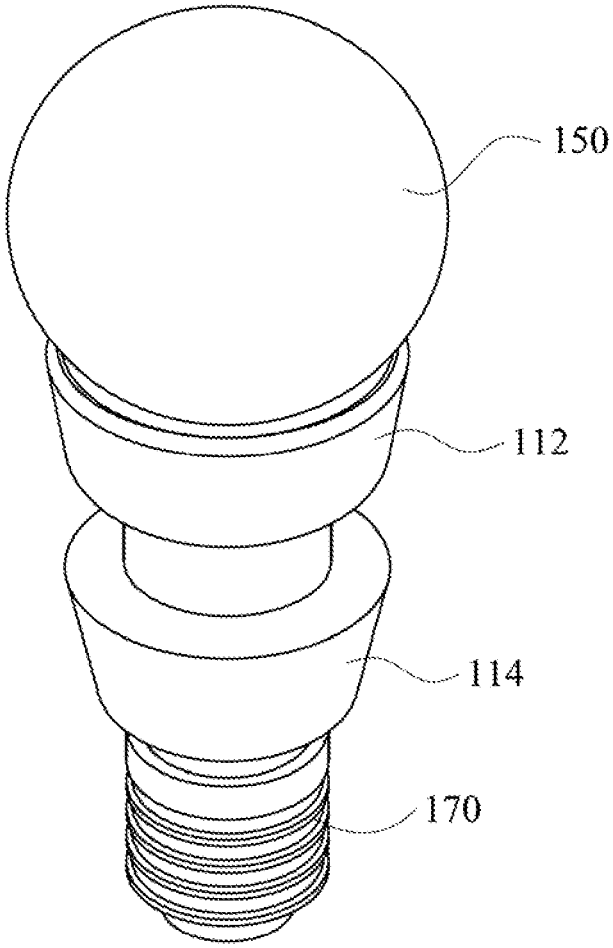
FIG. 3A is a schematic diagram showing a light emitting diode bulb in an omni-directional lighting mode in accordance with an embodiment of the present invention.
Figure 3B:
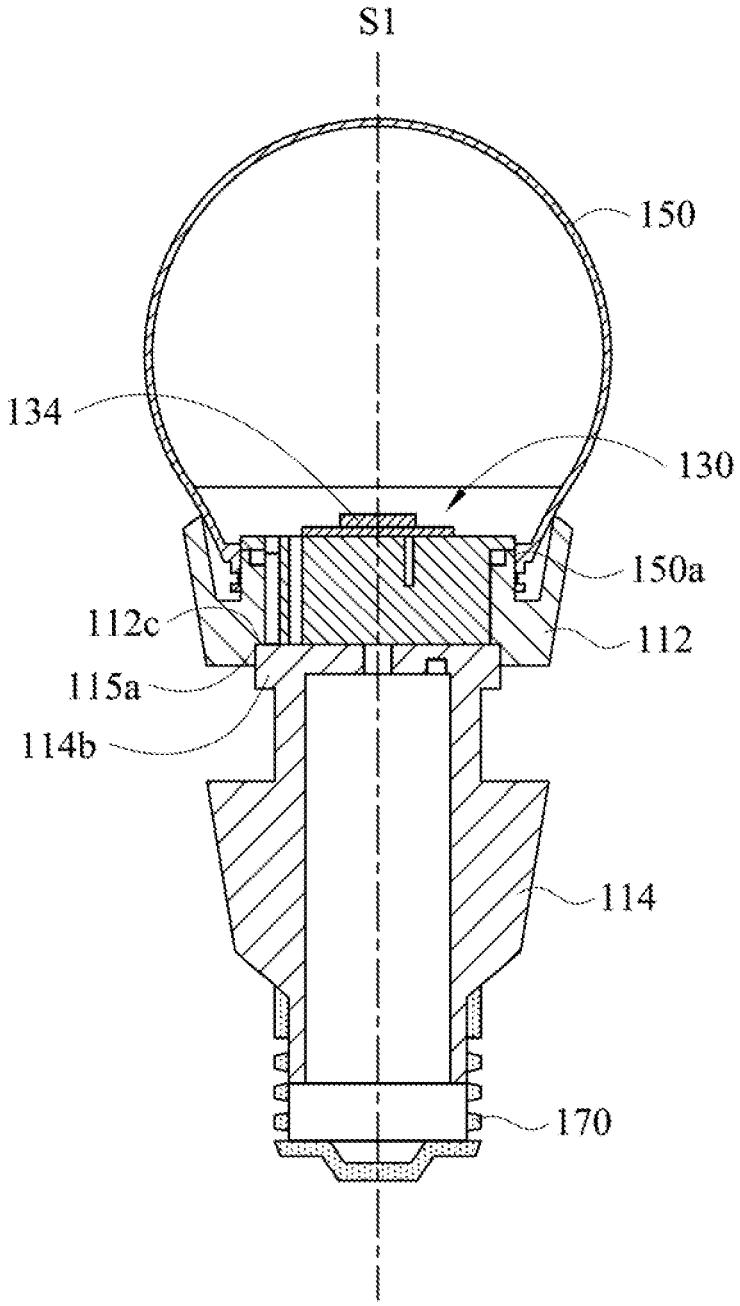
FIG. 3B is a schematic cross-sectional view of a light emitting diode bulb in an omni-directional lighting mode in accordance with an embodiment of the present invention.

Simultaneously refer to FIG. 2, FIG. 3A and FIG. 3B. FIG. 3A is a schematic diagram showing a light emitting diode bulb in an omni-directional lighting mode in accordance with an embodiment of the present invention, and FIG. 3B is a schematic cross-sectional view of a light emitting diode bulb in an omni-directional lighting mode in accordance with an embodiment of the present invention. As shown in FIG. 3A and FIG. 3B, when the second adjusting member 114 is fixed at the first position, the upper opposing surface 115*a* of the engaging structure 114*b* is against the second acting surface 112*c*. Meanwhile, when second adjusting member 114 is fixed at the first position, the flange 132*a* of the base 132 can be against the first acting surface 112*b*. In other words, when the second adjusting member 114 is fixed at the first position, the flange 132*a* of the base 132 can prevent the second adjusting member 114 from departing from the first adjusting member 112.

In one embodiment, the second acting surface 112*c* can be an inclined plane or a curved surface, and the inclined plane (or the curved surface) is inclined downward from a portion of the inclined plane (or the curved surface) away from the engaging structure 112*a* to a portion of the inclined plane for the curved surface) near the engaging structure 112*a*. In other words, the portion of the inclined plane (or the curved surface) away from the engaging structure 112*a* is higher than the portion of the inclined plane (or the curved surface) near the engaging structure 112*a*. With such design, when the engaging structure 114*b* is moved within the engaging structure 112*a* to align the upper opposing surface 115*a* of the engaging structure 114*b* to the second acting surface 112*c*, the second adjusting member 114 can be rotated around the axis S1 to make the upper opposing surface 115*a* be closely against the second acting surface 112*c*, so as to fix the second adjusting member 114 at the first position as shown in FIG. 3A and FIG. 3B. Meanwhile, the light source module 130 is located near a bottom edge of the lampshade 150. When the light emitting diode module 134 emits light, the light passing through the lampshade 150 can achieve an omni-directional lighting effect.

Figure 4A:
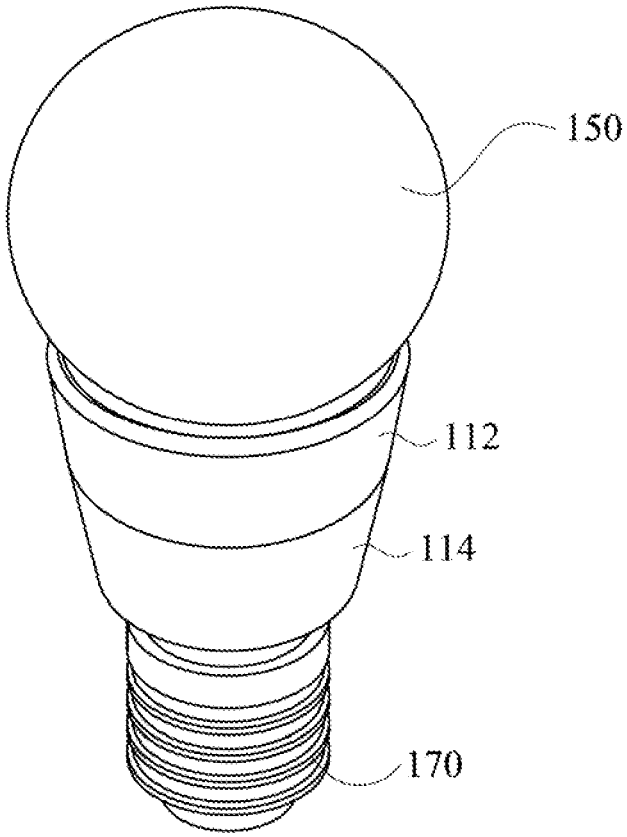
FIG. 4A is a schematic diagram showing a light emitting diode bulb in a semi-direction lighting mode in accordance with an embodiment of the present invention.
Figure 4B:
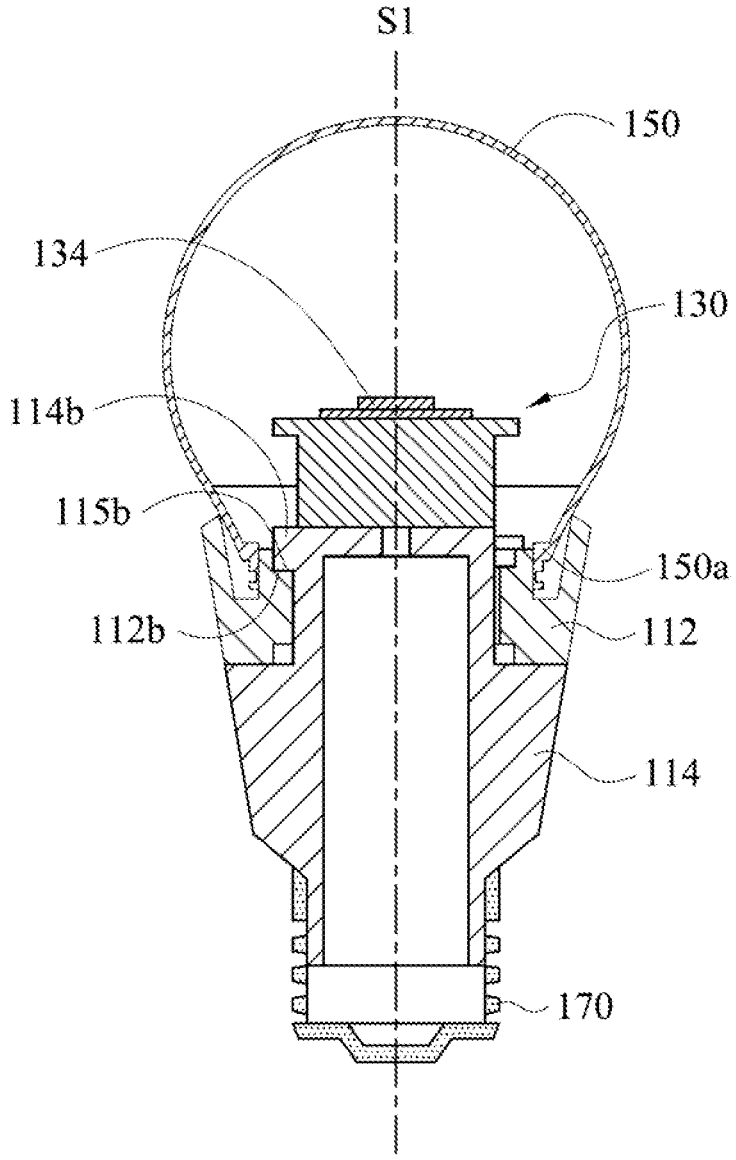
FIG. 4B is a schematic cross-sectional view of a light emitting diode bulb in a semi-directional lighting mode in accordance with an embodiment of the present invention.

Simultaneously refer to FIG. 2, FIG. 4A and FIG. 4B. FIG. 4A is a schematic diagram showing a light emitting diode bulb in a semi-directional lighting mode in accordance with an embodiment of the present invention, and FIG. 4B is a schematic cross-sectional view of a light emitting diode bulb in a semi-directional lighting mode in accordance with an embodiment of the present invention. When the second adjusting member 114 is fixed at the second position, the lower opposing surface 115*b* of the engaging structure 114*b* is against the first acting surface 112*b*. Similarly, in one embodiment, the first acting surface 112*b* can be an inclined plane or a curved surface, and the inclined plane (or the curved surface) is inclined downward from a portion of the inclined plane (or the curved surface) away from the engaging structure 112*a* to a portion of the inclined plane (or the curved surface) near the engaging structure 112*a*. In other words, the portion of the inclined plane (or the curved surface) away from the engaging structure 112*a* is higher than the portion of the inclined plane (or the curved surface) near the engaging structure 112*a*. With such design, when the engaging structure 114*b* is moved within the engaging structure 112*a* to align the lower opposing surface 115*b* of the engaging structure 114*b* to the first acting surface 112*b*, the second adjusting member 114 can be rotated around the axis S1 to make the lower opposing surface 115*b* be closely against the first acting surface 112*b*, so as to fix the second adjusting member 114 at the second position as shown in FIG. 4A and FIG. 4B. Meanwhile, the light source module 130 is located in the middle of the lampshade 150. When the light emitting diode module 134 emits light, the light passing through the lampshade 150 can achieve a semi-directional lighting effect.

The operating of switching the light emitting diode bulb 100 from the omni-directional lighting mode (as shown in FIG. 3A and FIG. 3B) to the semi-directional lighting mode (as shown in FIG. 4A and FIG. 4B) is described below. Firstly, the second adjusting member 114 is rotated along a direction from the engaging structure 114*b* to the engaging structure 112*a*. When the engaging structure 114*b* is moved to a position right below the engaging structure 112*a*, the second adjusting member 114 can be pushed towards the first adjusting member 112 to move the engaging structure 114*b* along the engaging structure 112*a*. When the lower opposing surface 115*b* of the engaging structure 114*b* aligns the first acting surface 112*b*, the second adjusting member 114 can be rotated to make the lower opposing surface 115*b* be against the first acting surface 112*b* so as to fix the second adjusting member 114.

Similarly, the second adjusting member 114 can be rotated again along the direction from the engaging structure 114*b* to the engaging structure 112*a* to switch the light emitting diode bulb 100 from the semi-directional lighting mode (as shown in FIG. 4A and FIG. 4B) to the omni-directional lighting mode (as shown in FIG. 3A and FIG. 3B). When the engaging structure 114*b* is moved to a position right above the engaging structure 112*a*, the second adjusting member 114 can be pulled away from the first adjusting member 112. Meanwhile, the engaging structure 114*b* is moved along the engaging structure 112*a*. When the upper opposing surface 115*a* of the engaging structure 114*b* aligns the second acting surface 112*c*, the second adjusting member 114 can be rotated to make the upper opposing surface 115*a* be against the second acting surface 112*c* so as to fix the second adjusting member 114.

It is noted that the engaging structure 112*a* being a recess, and the engaging structure 114*b* being a protruding block are merely used as an example for explanation in the aforementioned embodiment. In some embodiments, the engaging structure 112*a* is a protruding block, and the engaging structure 114*b* is a recess. In addition, numbers of the engaging structure 112*a* and the engaging structure 114*b* shown in the present embodiment are merely used as an example for explanation in the present embodiment. In some embodiments, the numbers and shapes of the engaging structure 112*a* and the engaging structure 114*b* can be changed according to design requirements.

Referring to FIG. 1 and FIG. 2 again, the first adjusting member 112 includes a retaining wall 112*e*. In the present embodiment, the convex wall 112*d* and the engaging structure 112*a* are disposed on the retaining wall 112*e*. Moreover, an accommodating space 112*f* is formed between the retaining wall 112*e* and an outer wall of the first adjusting member 112. Glue can be filled into the accommodating space 112*f* to adhere a bottom of the lampshade 150 within the accommodating space 112*f*. In some embodiments, the bottom of the lampshade 150 can be fixed within the accommodating space 112*f* by a wedging manner.

In other embodiments, the base 132 and the lamp cap 170 are made of Metal. In addition, the first adjusting member 112 and the second adjusting member 114 are made of heat conducting plastics. Therefore, heat generated by the light emitting diode modules 134 can be directly conducted from the base 132 to the second adjusting member 114 and further dissipated to the external atmosphere to achieve a superior heat dissipation efficacy. In one embodiment, the second adjusting member 114 is a hollow cylinder, in which an internal space of the hollow cylinder is used to accommodate the driving circuit and be filled with conductive glue, so as to increase heat conduction efficiency of the second adjusting member 114.

According to the aforementioned embodiments of the present invention, it is known that relative locations between a first adjusting member and a second adjusting member can be changed and fixed by using engaging structures and acting surfaces. Furthermore, a light source module can be moved with the second adjusting member to the bottom or the middle of a lampshade to switch the light emitting diode bulb to various lighting modes, so that the light emitting diode bulb can be switched to an omni-directional lighting mode or a semi-directional lighting mode. Accordingly, there is no need for users to purchase two types of light emitting diode bulbs with different light-emitting angles, which is more convenient for use. Furthermore, for manufacturers and sellers, manufacturing cost or selling cost can be reduced by manufacturing or selling single type of light emitting diode bulbs including two different light-emitting angles.

According to the aforementioned embodiments of the present invention, it is known that the first adjusting member and the second adjusting member are made of heat conducting plastics, and a base and a lamp cap are made of metal. By combing the base and the second adjusting member, heat generated by the light emitting diode modules can be directly conducted from the base to the second adjusting member and further dissipated to the external atmosphere to achieve a superior heat dissipation efficacy. Moreover, heat conducting plastics has functions of heat dissipation and electric insulation, thereby can prevent users from getting an electric shock or being scalded.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A light emitting diode bulb which has an axis and comprises:

a lamp housing comprising:

a first adjusting member, comprising:

at least one first engaging structure;

a first acting surface; and a second acting surface, wherein the first acting surface and second acting surface are respectively located on an upside and an underside of the first engaging structure; and a second adjusting member, which can be moved along the axis in relation to the first adjusting member and be fixed at a first position or a second position, wherein the second adjusting member comprises at least one second engaging structure corresponding to the at least one first engaging structure, and the second engaging structure comprises:

an upper opposing surface wherein when the second adjusting member is fixed at the first position, the upper opposing surface is against the second acting surface; and a lower opposing surface, wherein when the second adjusting member is fixed at the second position, the lower opposing surface is against the first acting surface;

a light source module which is disposed on the second adjusting member and is moved along the axis with the second adjusting member;

a lampshade which is disposed on a top end of the lamp housing and covers the light source module; and a lamp cap disposed on a bottom end of the lamp housing.

2. The light emitting diode bulb of claim 1, wherein each of the first acting surface and the second acting surface is an inclined plane, and the inclined plane is inclined downward from a portion of the inclined plane away from the at least one first engaging structure to a portion of the inclined plane near the at least one first engaging structure.

3. The light emitting diode bulb of claim 1, wherein each of the first acting surface and the second acting surface is a curved surface, and the curved surface is inclined downward from a portion of the inclined plane away from the at least one first engaging structure to a portion of the inclined plane near the at least one first engaging structure.

4. The light emitting diode bulb of claim 1, wherein the at least one first engaging structure is a recess, and the at least one second engaging structure is a protruding block.

5. The light emitting, diode bulb of claim 1, wherein the light source module comprises:

a base fixed on the second adjusting member, wherein the base has a flange, when the second adjusting member is fixed at the first position, the flange is against the first acting surface; and at least one light emitting diode module disposed on the base.

6. The light emitting diode bulb of claim 1, wherein the second adjusting member comprises an extending portion, the first adjusting member is an annular structure, and the first adjusting member is put around the extending portion.

7. The light emitting diode bulb of claim 6, wherein the first adjusting member comprises a retaining wall, an accommodating space is formed between the retaining wall and an outer wall of the first adjusting member, and a bottom of the lampshade is disposed within the accommodating space.

8. The light emitting diode bulb of claim 7, wherein the at least one first engaging structure is disposed on the retaining wall.

9. The light emitting diode bulb of claim 1, wherein the base and the lamp cap are made of metal.

10. The light emitting diode bulb of claim 1, wherein the first adjusting member and the second adjusting member are made of heat conducting plastics.

* * * * *